US007549198B2

(12) United States Patent
Gosis et al.

(10) Patent No.: US 7,549,198 B2
(45) Date of Patent: Jun. 23, 2009

(54) SEALED JOINT DEVICES FOR SECURING STRAP ENDS TOGETHER

(75) Inventors: Anatoly Gosis, Palatine, IL (US); Donald L. Van Erden, Wildwood, IL (US); Deepak Mehta, Naperville, IL (US); Manuel Enriquez, Morton Grove, IL (US); Abram Cervantes, Chicago, IL (US); Penmetesa N. Varma, Maharastra (IN)

(73) Assignee: Illinois Tool Works Inc., Glenview, IL (US)

( * ) Notice: Subject to any disclaimer, the term of this patent is extended or adjusted under 35 U.S.C. 154(b) by 360 days.

(21) Appl. No.: 11/046,248

(22) Filed: Jan. 31, 2005

(65) Prior Publication Data

US 2006/0168768 A1 Aug. 3, 2006

(51) Int. Cl.
*B65D 63/06* (2006.01)

(52) U.S. Cl. ..... 24/20 W; 24/23 W

(58) Field of Classification Search ..... 24/16 PB, 24/16 R, 17 A, 17 AP, 136 R, 115 R, 136 K, 24/136 A, 20 CW, 20 W, 23 W
See application file for complete search history.

(56) References Cited

U.S. PATENT DOCUMENTS

| | | | |
|---|---|---|---|
| 293,919 | A | 2/1884 | Sprout |
| 1,173,998 | A | 2/1916 | Depew |
| RE14,482 | E | 6/1918 | Rothermel |
| 1,283,062 | A | 10/1918 | Brooks |
| 1,290,707 | A | 1/1919 | Brooks |
| 1,393,791 | A | 10/1921 | Kimball et al. |
| 1,893,901 | A | 1/1933 | McGregor et al. |
| 2,177,536 | A | 10/1939 | Porter |
| 2,356,059 | A | 8/1944 | Humphner |
| 2,432,306 | A | 12/1947 | Gerrard et al. |
| 2,494,386 | A | 1/1950 | Gillman |
| 2,680,979 | A | 6/1954 | Childress |
| 2,710,435 | A | 6/1955 | Crosby |
| 3,089,366 | A | 5/1963 | Haraden |
| 3,166,960 | A | 1/1965 | Roessler |
| 3,224,055 | A | 12/1965 | Orser |
| 3,237,256 | A | 3/1966 | Young |
| 3,333,607 | A | 8/1967 | Haraden |

(Continued)

*Primary Examiner*—Robert J Sandy
*Assistant Examiner*—Ruth C Rodriguez
(74) *Attorney, Agent, or Firm*—Law Offices of Steven W. Weinrieb

(57) ABSTRACT

A new and improved sealed joint or system is disclosed for securing together the opposite ends of plastic strapping, which is encircled around the package or bale, in order to ensure that the opposite ends of the plastic strapping do not exhibit any slipping or relative movement with respect to each other whereby the predeterminedly formed size or shape of the package or bale is able to be preserved or maintained. In accordance with various different embodiments of the present invention, different arrangements of the sealed joint, with respect to the opposite ends of the plastic strapping, are structured whereby enhanced frictional contact is effectively developed between the sealed joint and the opposite ends of the plastic strapping, or between the opposite ends of the plastic strapping per se, so as to in fact reduce the amount of slipperiness effectively defined between the opposite ends of the plastic strapping. In accordance with a still further embodiment of the present invention, the opposite ends of the plastic strapping are effectively locked within a tubular sleeve member, by means of a chain-link type insert, such that the opposite ends of the plastic strapping are positionally fixed with respect to each other.

12 Claims, 2 Drawing Sheets

U.S. PATENT DOCUMENTS 3,636,592 A 1/1972 Beach
3,736,627 A * 6/1973 Sosinski ..... 24/23 W
3,875,618 A * 4/1975 Schuplin ..... 24/16 PB
4,165,943 A 8/1979 Beach et al.
4,253,227 A 3/1981 Bullington
4,422,217 A * 12/1983 Barrette ..... 24/16 PB
4,466,535 A 8/1984 Huson
4,498,507 A * 2/1985 Thompson ..... 24/16 PB
4,501,356 A 2/1985 Urban et al.
4,566,378 A 1/1986 Fleissner
4,993,669 A * 2/1991 Dyer ..... 24/16 PB
5,078,185 A 1/1992 Angarola
5,102,075 A * 4/1992 Dyer ..... 24/16 PB
5,109,575 A 5/1992 Angarola
5,544,391 A * 8/1996 Hoffman ..... 24/16 PB
5,630,252 A * 5/1997 Wells ..... 24/16 PB
6,128,809 A * 10/2000 Khokhar ..... 24/16 PB
6,338,184 B1 1/2002 Angarola et al.
6,446,474 B1 * 9/2002 Tabacchi et al. ..... 24/16 PB
6,928,701 B2 * 8/2005 Hutter, III ..... 24/16 PB

* cited by examiner

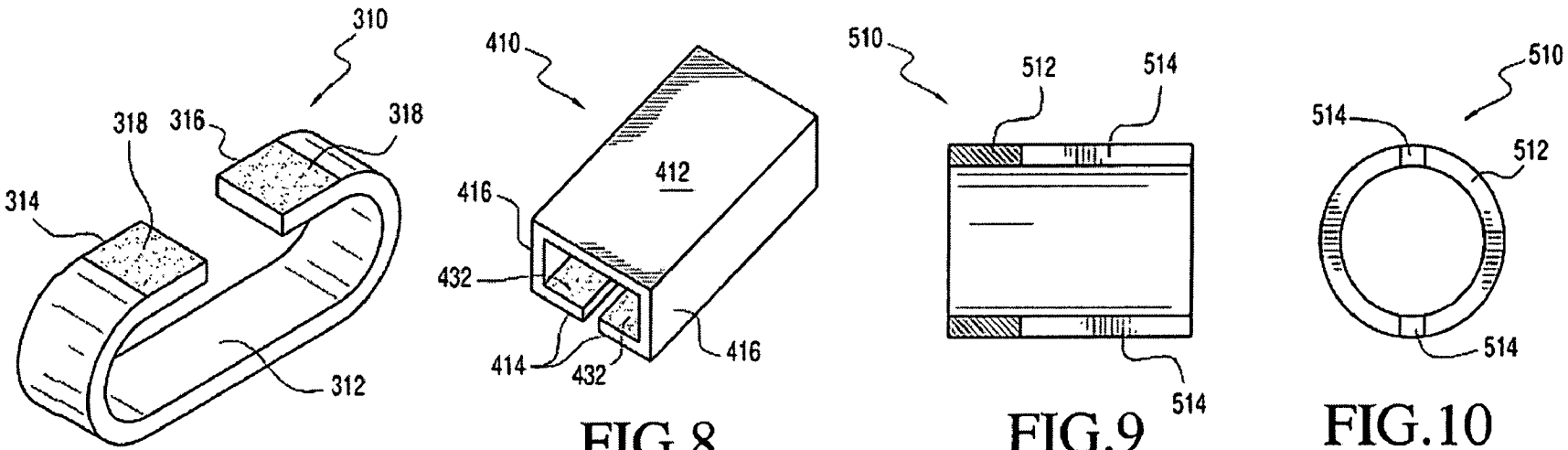
FIG.7
FIG.8
FIG.9
FIG.10
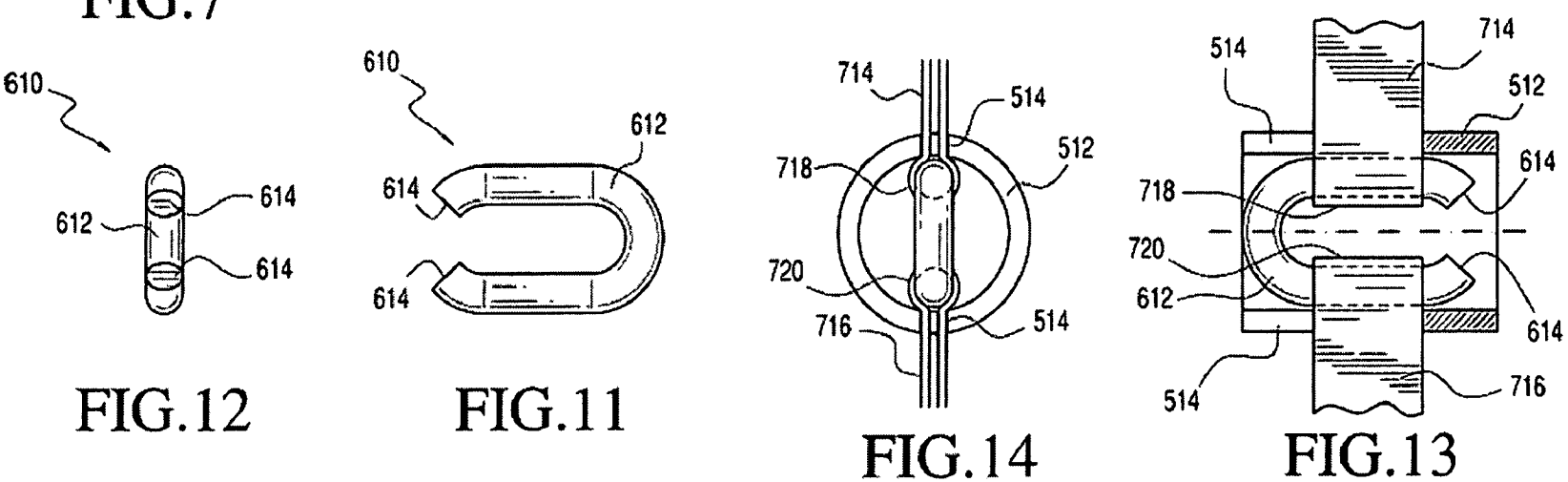
FIG.11
FIG.12
FIG.13
FIG.14

SEALED JOINT DEVICES FOR SECURING STRAP ENDS TOGETHER

FIELD OF THE INVENTION

The present invention relates generally to package or bale strapping systems, and more particularly to a new and improved sealed joint, or system, for securing together the opposite ends of plastic strapping which is encircled around the package or bale in order to ensure that the opposite ends of the plastic strapping do not exhibit any slipping or relative movement with respect to each other whereby the predeterminedly formed size or shape of the package or bale is able to be preserved or maintained, and that, in addition, the structural integrity of the package or bale is maintained during, for example, transportation, shipping, and handling of the bale or package.

BACKGROUND OF THE INVENTION

Agricultural products or materials, such as, for example, jute, cotton, or the like, are commonly formed into bales within various different types of baling apparatus. The materials from which the bales are formed are initially compressed to a fraction of their original size, the compressed materials are then encircled within suitable strapping members, which may be fabricated from various materials, such as, for example, a suitable metal or plastic material, and subsequently still further, the opposite ends of the strapping members are fixedly secured together by means of a suitable sealed joint so as to retain the compressed baled material in its compressed state. Subsequent to the aforenoted baling of the material, the encircling of the baled material within the strapping members, and the fixation of the sealed joint upon the opposite ends of the strapping members, the baled material will naturally or inherently tend to expand with a considerable amount of force, sometimes within the range of, for example, 2000 pounds psi.

The sealed joint usually comprises a crimped member, and accordingly, when the sealed joint is utilized in conjunction with metal strapping, the metal strapping is sufficiently deformed to a predetermined degree, within localized areas or regions, such that a secure sealed joint system is in fact able to be defined between the sealed joint and the ends of the strapping members. It has been experienced, however, that when a similar sealed joint is utilized in conjunction with plastic strapping, such as, for example, polyester or polypropylene materials, the crimping of the sealed joint onto the opposite ends of the strapping members is often insufficient to fixedly retain the strapping members securely fixed upon the baled material due to the inherent or natural degree of slipperiness of the plastic materials with respect to each other. Alternatively, if the degree, to which the sealed joint is crimped onto the plastic strapping members, is increased or enhanced, the structural integrity of portions of the plastic strapping members is sometimes compromised such that, again, the opposite ends of the strapping members are not fixedly retained in a secure manner upon the baled material.

A need therefore exists in the art for a new and improved sealed joint, or system, for securing together the opposite ends of plastic strapping which is encircled around the package or bale in order to ensure that the opposite ends of the plastic strapping do not exhibit any slipping or relative movement with respect to each other whereby the predeterminedly formed size or shape of the package or bale is able to be preserved or maintained, and that, in addition, the structural integrity of the package or bale is maintained during, for example, transportation, shipping, and handling of the bale or package.

SUMMARY OF THE INVENTION

The foregoing and other objectives are achieved in accordance with the teachings and principles of the present invention through the provision of a new and improved sealed joint, or system, for securing together the opposite ends of plastic strapping, which is encircled around the package or bale, in order to ensure that the opposite ends of the plastic strapping do not exhibit any slipping or relative movement with respect to each other whereby the predeterminedly formed size or shape of the package or bale is able to be preserved or maintained, and that, in addition, the structural integrity of the package or bale is maintained during, for example, transportation, shipping, and handling of the bale or package. More particularly, in accordance with various different embodiments of the present invention, different arrangements of the sealed joint, with respect to the opposite ends of the plastic strapping, are structured by means of which enhanced frictional contact is effectively developed between the sealed joint and the opposite ends of the plastic strapping, or between the opposite ends of the plastic strapping per se, so as to in fact reduce the amount of slipperiness effectively defined between the opposite ends of the plastic strapping. In accordance with a still further embodiment of the present invention, the opposite ends of the plastic strapping are effectively locked within a tubular sleeve member, by means of a chain-link type insert, such that the opposite ends of the plastic strapping are positionally fixed with respect to each other.

BRIEF DESCRIPTION OF THE DRAWINGS

Various other features and attendant advantages of the present invention will be more fully appreciated from the following detailed description when considered in connection with the accompanying drawings in which like reference characters designate like or corresponding parts throughout the several views, and wherein:

FIG. 7 is a perspective view of a plastic strapping, of the type to be used in connection with baled materials, wherein the opposite ends of the plastic strapping have grit, or similar friction enhancing materials, disposed upon the oppositely disposed surface portions of each one of the opposite ends of the plastic strapping such that when the opposite ends of the plastic strapping are overlapped with respect to each other, the frictional contact, defined between the oppositely disposed surface portions of the opposite ends of the plastic strapping, is enhanced;

FIG. 8 is a perspective view of a third embodiment of a sealed joint housing within which the opposite ends of the plastic strapping as disclosed within FIG. 7 are to be inserted prior to the crimping of the sealed joint housing onto the opposite ends of the plastic strapping so as to fixedly secure the opposite ends of the plastic strapping together;

FIG. 9 is a cross-sectional view of a fourth embodiment of a sealed joint housing within which opposite ends of the plastic strapping are to be inserted so as to be fixedly secured within the sealed joint housing, wherein the sealed joint housing has a substantially tubular configuration;

FIG. 10 is an end elevation view of the sealed joint housing disclosed within FIG. 9;

FIG. 11 is a side elevation view of a fourth embodiment of a sealed joint insert to be disposed within the sealed joint housing disclosed within FIGS. 9 and 10 so as to operatively cooperate with the sealed joint housing disclosed within FIGS. 9 and 10 in forming a sealed joint assembly for fixedly securing the opposite ends of the plastic strapping within the sealed joint assembly;

FIG. 12 is an end elevation view of the sealed joint insert disclosed within FIG. 11;

FIG. 13 is a cross-sectional view of the sealed joint assembly, comprising the sealed joint housing disclosed within FIGS. 9 and 10, and the sealed joint insert disclosed within FIGS. 11 and 12 and operatively cooperating with the sealed joint housing so as to form the sealed joint assembly which effectively fixedly secures the opposite ends of the plastic strapping within the sealed joint assembly; and FIG. 14 is an end elevation view of the sealed joint assembly disclosed within FIG. 13 showing how the sealed joint insert operatively cooperates with the sealed joint housing so as to fixedly secure the opposite ends of the plastic strapping within the sealed joint assembly.

DETAILED DESCRIPTION OF THE PREFERRED EMBODIMENT

Figure 1:
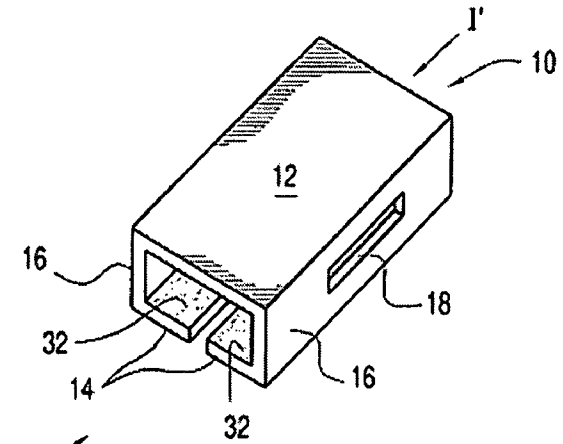
FIG. 1 is a perspective view of a first embodiment of a sealed joint housing within which opposite ends of the plastic strapping are to be inserted prior to the crimping of the sealed joint housing onto the opposite ends of the plastic strapping so as to fixedly secure the opposite ends of the plastic strapping together.

Referring now to the drawings, and more particularly to FIG. 1 thereof, a first embodiment of a sealed joint housing, within which the opposite ends of a plastic strapping are to be inserted prior to the crimping of the sealed joint housing onto the opposite ends of the plastic strapping so as to fixedly secure the opposite ends of the plastic strapping together, is disclosed and is generally indicated by the reference character 10. More particularly, it is seen that the sealed joint housing 10 is fabricated from a plate which is formed into a tubular structure having a geometrical configuration that comprises a parallelepiped which includes an upper wall member 12, a pair of lower wall members 14,14 disposed adjacent to each other, and a pair of oppositely disposed side wall members 16,16, the oppositely disposed ends of the sealed joint housing 10 being open so as to permit the opposite end portions of the plastic strapping to be inserted into the sealed joint housing 10 in the opposite directions schematically indicated by the reference characters I and I'. It is noted further that each one of the pair of oppositely disposed side wall members 16,16 is provided with an entrance slot 18 wherein the oppositely disposed slots 18,18, as may best be appreciated from FIG. 3, are aligned with each other.

Figure 3:
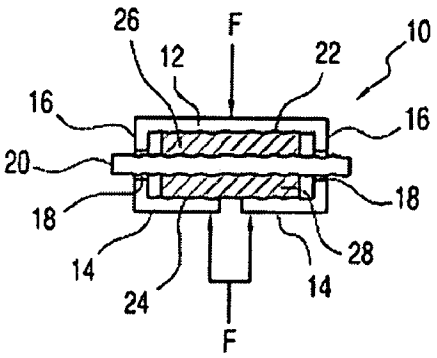
FIG. 3 is a cross-sectional view showing the sealed joint assembly, comprising the sealed joint housing disclosed within FIG. 1, the sealed joint insert disclosed within FIG. 2, and the opposite ends of the plastic strapping disposed within the sealed joint assembly, prior to the imposition of the crimping forces upon the sealed joint housing.
Figure 2:
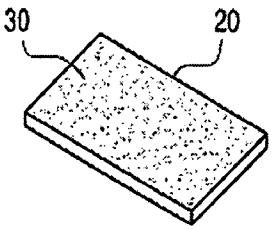
FIG. 2 is a perspective view of a first embodiment of a sealed joint insert which is adapted to be inserted into the sealed joint housing disclosed within FIG. 1 so as to form, with the sealed joint housing disclosed within FIG. 1, a sealed joint assembly for fixedly securing the opposite ends of the plastic strapping together when the sealed joint housing is crimped with respect to the sealed joint insert and the opposite ends of the plastic strapping disposed within the sealed joint housing.

In this manner, a sealed joint insert 20, as disclosed within FIG. 2, is able to be inserted into the sealed joint housing 10, in a transverse orientation, so as to effectively divide the interior of the sealed joint housing 10 into an upper space 22 and a lower space 24 within which the opposite ends 26,28 of a plastic strapping can be respectively accommodated, all as more clearly illustrated within FIG. 3. It is noted that the sealed joint insert 20 has a substantially rectangular configuration, and it is to be noted still further that, in accordance with a unique and novel feature characteristic of the present invention, both the upper and lower surface portions of the sealed joint insert 20 have friction-enhancing material, such as, for example, grit 30, disposed thereon. In a similar manner, the interior surface portions of the upper and lower wall members 12,14,14 of the sealed joint housing 10 are likewise provided with friction-enhancing material 32. As can therefore best be appreciated from FIG. 3, when the sealed joint insert 20 is disposed within the sealed joint housing 10, and when the opposite ends 26,28 of the plastic strapping have been inserted into the upper and lower spaces 22,24 defined within the sealed joint housing 10, the upper surface portion of the sealed joint insert 20, having the friction-enhancing material 30 disposed thereon, will be disposed in contact with the undersurface portion of the strapping end 26, while the undersurface portion of the upper wall member 12 of the sealed joint housing 10, having the friction-enhancing material 32 disposed thereon, will be disposed in contact with the upper surface portion of the strapping end 26. In a similar manner, the undersurface portion of the sealed joint insert 20, having the friction-enhancing material 30 disposed thereon, will be disposed in contact with the upper surface portion of the strapping end 28, while the upper surface portions of the lower wall members 14,14 of the sealed joint housing 10, having the friction-enhancing material 32 disposed thereon, will be disposed in contact with the undersurface portion of the strapping end 28.

Accordingly, when crimping forces F are impressed upon the upper and lower wall members 12,14,14 of the sealed joint housing 10, the undersurface and upper surface portions of the upper and lower wall members 12,14,14 of the sealed joint housing 10, having the friction-enhancing material 32 disposed thereon, and the upper and lower surface portions of the sealed joint insert 20, having the friction-enhancing material 30 disposed thereon, will cooperate together so as to engage both the upper and lower surface portions of each one of the opposite ends 26,28 of the plastic strapping with significant frictional forces whereby each one of the opposite ends 26,28 of the plastic strapping is fixedly secured within the sealed joint housing 10. In particular, it is noted that in accordance with the unique and novel teachings of the present invention, the opposite ends 26,28 of the plastic strapping are not disposed in contact with each other but, to the contrary, each one of the opposite ends 26,28 of the plastic strapping is in effect sandwiched between one of the interior surface portions of the upper or lower wall members 12,14 of the sealed joint housing 10 and a corresponding one of the upper or lower surface portions of the sealed joint insert 20. Accordingly, the degree of frictional contact developed in connection with each one of the opposite ends 26,28 of the plastic strapping is significantly enhanced while, conversely or correspondingly, the degree of slipperiness ordinarily developed between the opposite ends 26,28 of the plastic strapping has effectively been eliminated.

Figure 4:
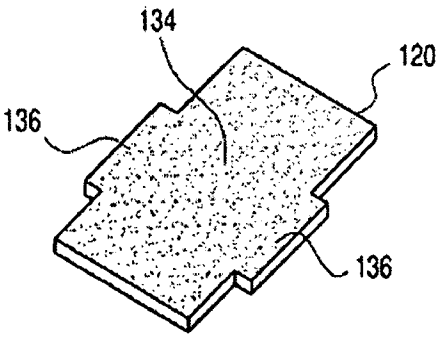
FIG. 4 is a perspective view of a second embodiment of a sealed joint insert which is adapted to be disposed within the sealed joint housing disclosed within FIG. 1 so as to form, with the sealed joint housing disclosed within FIG. 1, a sealed joint assembly for fixedly securing the opposite ends of the plastic strapping together when the sealed joint housing is crimped with respect to the sealed joint insert and the opposite ends of the plastic strapping disposed within the sealed joint housing, wherein the sealed joint insert is effectively locked within the sealed joint housing, prior to the insertion of the opposite ends of the plastic strapping within the sealed joint housing, so as to form, with the sealed joint housing, a single sealed joint assembly entity, comprising the two sealed joint housing and sealed joint insert components, such that the sealed joint insert cannot be separated from the sealed joint housing.

With reference now being made to FIG. 4, a second embodiment of a sealed joint insert, which may likewise be inserted within and employed in connection with the sealed joint housing 10 as disclosed within FIG. 1, is disclosed at 120, and it is seen that the sealed joint insert 120 has a substantially t-shaped or +-shaped configuration. More particularly, the sealed joint insert 120 comprises a primary, longitudinally extending body portion 134, which is adapted to be oriented along the longitudinal extent or axis of the sealed joint housing 10, and a pair of lugs or ears 136 which are integrally disposed upon the oppositely disposed side edge portions of the body portion 134 and which are adapted to project outwardly through the slots 18,18 defined within the side wall members 16,16 of the sealed joint housing 10 when the sealed joint insert 120 is disposed internally within the sealed joint housing 10. It is to be noted that the sealed joint insert 120 is effectively mated with the sealed joint housing 10 in such a manner that the pair of lugs or ears 136 of the sealed joint insert 120 will be inserted outwardly through the slots 18,18 defined within the side wall members 16,16 of the sealed joint housing 10 prior to the complete folding and formation of the sealed joint housing 10 into its finalized form as illustrated within FIG. 1.

The advantage of utilizing the sealed joint insert 120, as illustrated within FIG. 4, in conjunction with the sealed joint housing 10 as illustrated within FIG. 1, as compared to the use of the sealed joint insert 20, as illustrated within FIG. 2, in conjunction with the sealed joint housing 10 as illustrated within FIG. 1, is that once the sealed joint insert 120 is assembled internally within the sealed joint housing 10, it cannot become separated from the sealed joint housing 10 as can the sealed joint insert 20. As has been noted hereinbefore, the sealed joint insert 20 is simply assembled with the sealed joint housing 10 by inserting the same transversely through the slots 18,18 defined within the side wall members 16,16 of the sealed joint housing 10. Accordingly, the sealed joint insert 20 can likewise be easily removed or become separated from the sealed joint housing 10 as a result of its complete reverse transverse movement outwardly through one of the slots 18,18 defined within the side wall members 16,16 of the sealed joint housing 10. On the other hand, or to the contrary, the sealed joint insert 120 can be separated from the sealed joint housing 10 in view of the fact that if it is attempted to move the sealed joint insert 120 in either one of the longitudinal directions with respect to the sealed joint housing 10, the lugs or ears 136, 136 of the sealed joint insert 120 will encounter end portions of the slots 18,18 defined within the side wall members 16,16 of the sealed joint housing 10, whereas in a similar manner, if it is attempted to move the sealed joint insert 120 in either one of the transverse directions with respect to the sealed joint housing 10, the oppositely disposed side edge portions of the opposite ends of the primary body portion 134 of the sealed joint insert 120 will effectively encounter the internal surface portions of the side wall members 16,16.

Figure 6:
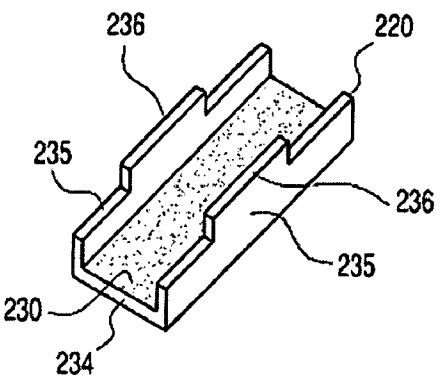
FIG. 6 is a perspective view of a third embodiment of a sealed joint insert which is adapted to be inserted into the sealed joint housing disclosed within FIG. 4 so as to form, with the sealed joint housing disclosed within FIG. 4, a sealed joint assembly for fixedly securing the opposite ends of the plastic strapping together when the sealed joint housing is crimped with respect to the sealed joint insert and the opposite ends of the plastic strapping disposed within the sealed joint housing.
Figure 5:
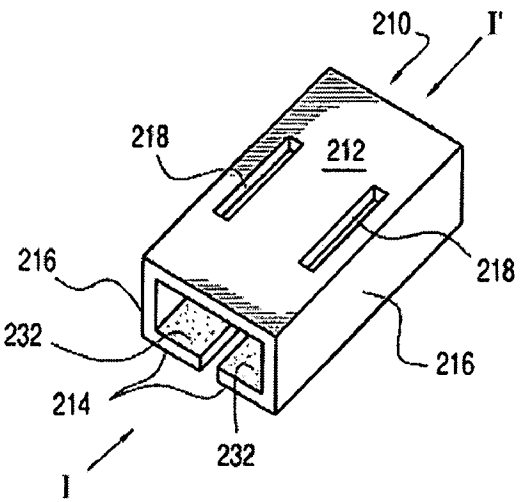
FIG. 5 is a perspective view of a second embodiment of a sealed joint housing within which opposite ends of the plastic strapping are to be inserted prior to the crimping of the sealed joint housing onto the opposite ends of the plastic strapping so as to fixedly secure the opposite ends of the plastic strapping together.

With reference now being made to FIG. 5, a second embodiment of a sealed joint housing, within which the opposite ends of a plastic strapping are to be inserted prior to the crimping of the sealed joint housing onto the opposite ends of the plastic strapping so as to fixedly secure the opposite ends of the plastic strapping together, is disclosed and is generally indicated by the reference character 210. More particularly, it is seen that the sealed joint housing 210 is somewhat similar to the sealed joint housing 10, as disclosed within FIG. 1, in that the same is fabricated from a plate which is formed into a tubular structure having a geometrical configuration that comprises a parallelepiped. In particular, the sealed joint housing 210 comprises an upper wall member 212, a pair of lower wall members 214,214 disposed adjacent to each other, and a pair of oppositely disposed side wall members 216,216, the oppositely disposed ends of the sealed joint housing 210 being open so as to permit the opposite end portions of the plastic strapping to be inserted into the sealed joint housing 210 in the opposite directions schematically indicated by the reference characters I and I'. It is noted further that, contrary to the first embodiment of the sealed joint housing 10 wherein each one of the pair of oppositely disposed side wall members 16,16 was provided with an entrance slot 18 which were effectively aligned with each other, a pair of slots 218,218 is formed within the upper wall member 212. In this manner, a third embodiment sealed joint insert 220, as disclosed within FIG. 6, is able to be disposed within the sealed joint housing 210 so as to effectively divide the interior of the sealed joint housing 210 into an upper space and a lower space within which the opposite ends of a plastic strapping can be respectively accommodated in a manner similar to that as has been illustrated within FIG. 3 with respect to the sealed joint insert 20 being disposed internally within the sealed joint housing 10.

It is noted that the sealed joint insert 220 has a substantially C-shaped cross-sectional configuration wherein the same comprises a floor portion 234 and a pair of longitudinally oriented, upstanding side wall members 235,235. Each one of the longitudinally oriented, upstanding side wall members 235,235 has an upstanding lug or ear 236 integrally formed upon the upper edge portion thereof for respective insertion within the slots 218,218 formed within the upper wall member 212 of the sealed insert housing 210. It is noted still further that the height or depth dimension of each one of the upstanding side wall members 235,235, including the upstanding lug or ear 236 respectively disposed thereon, may be less than the vertical extent of the interior space defined within the sealed joint housing 210 as measured between the undersurface portion of the upper wall member 212 and the upper surface portion of the lower wall members 214,214. In this manner, the sealed joint insert 220 may simply and easily be inserted into the sealed joint housing 210 along either one of the longitudinal directions I,I' and subsequently moved upwardly whereby the upstanding lugs or ears 236,236 will be respectively disposed within the slots 218,218 of the upper wall member 212 of the sealed joint housing 210 while the floor portion 234 of the sealed joint insert 220 effectively divides the interior space of the sealed joint housing 210 into the upper and lower spaces within which the opposite ends of a plastic strapping can be respectively accommodated in a manner similar to that as has been illustrated within FIG. 3 as a result of the sealed joint insert 20 having been disposed internally within the sealed joint housing 10.

Alternatively, the height or depth dimension of each one of the upstanding side wall members 235,235, including the upstanding lug or ear 236 respectively disposed thereon, may be somewhat larger than the vertical extent of the interior space defined within the sealed joint housing 210 as measured between the undersurface portion of the upper wall member 212 and the upper surface portion of the lower wall members 214, 214. In this case, the sealed joint insert 220 is effectively mated with the sealed joint housing 210 in such a manner that the pair of lugs or ears 236,236 of the sealed joint insert 220 will be inserted within the slots 218,218 defined within the upper wall member 212 of the sealed joint housing 210 prior to the complete folding and formation of the sealed joint housing 210 into its finalized form as illustrated within FIG. 5. The advantages to this structural inter-cooperation defined between the sealed joint insert 220 and the sealed joint housing 210 are similar to those achieved in connection with the sealed joint insert 120 and the sealed joint housing 10 in that once the sealed joint insert 220 and the sealed joint housing 210 are mated together, the sealed joint insert 220 cannot be readily separated from the sealed joint housing 210. As was also previously noted in connection with the sealed joint insert 120 and the sealed joint housing 10, both the upper and lower surface portions of the sealed joint insert 220 have friction-enhancing material, such as, for example, grit 230, disposed thereon, while the interior surface portions of the upper and lower wall members 212,214,214 of the sealed joint housing 210 are likewise provided with friction-enhancing material 232.

Turning now to FIG. 7, a plastic strapping, of the type to be used in connection with the encircled strapping of baled materials, is disclosed and is generally indicated by the reference character 310. The plastic strapping 310 is seen to comprise an elongate body portion 312 and a pair of opposite ends 314,316 which are adapted to be fixedly secured together so as to effectively maintain or preserve the baled material in its compressed, baled state. In accordance with one of the unique and novel features characteristic of the present invention, it is further seen that each one of the opposite ends 314,316 of the plastic strapping 310 have grit 318, or other similar friction enhancing material, disposed upon both of the oppositely disposed surface portions, that is, both the upper and undersurface portions thereof such that when the opposite ends 314,316 of the elongate plastic strapping 310 are overlapped with respect to each other, regardless of whether the end portion 314 is disposed atop the opposite end portion 316, or whether the end portion 316 is disposed atop the opposite end portion 314, the frictional contact, defined between the oppositely disposed surface portions of the opposite ends 314,316 of the plastic strapping 310, is enhanced. It is to be further appreciated that, in accordance with the usage of the plastic strapping 310 as disclosed within FIG. 7, since there is mutual frictional contact already developed between the overlapped surface portions of the opposite ends 314,316 of the strapping 310, the opposite ends 314,316 of the strapping 310 may simply be inserted into a sealed joint housing which is disclosed within FIG. 8 and which is generally indicated by the reference character 410.

It can be further appreciated that the sealed joint housing 410 is substantially similar to either one of the sealed joint housings 10,210 as respectively disclosed within FIGS. 1 and 5, however, as can readily be seen, the side wall members 416 and the upper wall member 412 do not contain any slots similar to the slots 18,218 respectively provided within the side wall members 16,16 and the upper wall member 212 of the sealed joint housings 10,210. The reason for this is that as a result of the disposition of the friction enhancing material 318 upon both the upper and lower surface portions of each one of the opposite ends 314,316 of the plastic strapping 310, and as a result of the provision of similar friction enhancing material 432 upon the interior, undersurface portion of the upper wall member 412 of the sealed joint housing 410, as well as upon the interior, upper surface portions of the lower wall members 414,414 of the sealed joint housing 410, there is no need for utilizing a sealed joint insert.

More particularly, when the opposite ends 314,316 of the plastic strapping 310 are inserted into the interior space defined within the sealed joint housing 410 such that, for example, the end 314 of the plastic strap-ping 310 will be disposed atop the opposite end 316 of the plastic strapping 310, then the upper surface portion of the end 314 of the plastic strapping 310 will be disposed in frictional contact with the undersurface portion of the upper wall member 412 of the sealed joint housing 410, the undersurface portion of the end 314 of the plastic strapping 310 will be disposed in frictional contact with the upper surface portion of the opposite end 316 of the plastic strapping 310, and the undersurface portion of the end 316 of the plastic strapping 310 will be disposed in frictional contact with the upper surface portions of the lower wall members 414,414 of the sealed joint housing 410. Therefore, as was the case with any one of the previously disclosed sealed joint assemblies, as exemplified by the sealed joint assembly disclosed within FIG. 3, any two surfaces of the plastic strapping, of the sealed joint housing, or of the sealed joint insert, that are disposed in contact with each other, are characterized by means of enhanced frictional contact. It is lastly noted in connection with the frictional material utilized upon the surface portions of the sealed joint housings, the sealed joint inserts, and the opposite ends of the plastic strapping, that while such frictional material has been noted as being, for example, grit, other frictional materials or means can likewise be employed, such as, for example, knurled surface regions, angled teeth, barbs, prongs, or the like.

With reference lastly being made to FIGS. 9-14, another type of assembly, for fixedly securing together the opposite ends of plastic strapping disposed around baled materials, is disclosed. In accordance the teachings and principles of the present invention, this last assembly for fixedly securing together the opposite ends of plastic strapping disposed around baled materials is seen to comprise, for example, a sealed joint housing, which is generally indicated by the reference character 510, and a sealed joint insert which is generally indicated by the reference character 610. More particularly, it is seen that the sealed joint housing 510 comprises a tubular member 512 having a circular cross-sectional configuration, and as can best be appreciated from FIGS. 9, 10, 14, and 15, a pair of slits 514,514 are formed within diametrically opposed regions of the tubular member 512, the slits 514,514 extending from one open end of the tubular member 512 for an axial extent equal to approximately one-half or two-thirds of the entire axial length of the tubular member 512. The sealed joint insert 610 is seen to comprise an open, chain-link type member 612 having a substantially C-shaped configuration, wherein the member 612 also has free end portions 614,614. The diametrical extent of the sealed joint insert member 612 is also slightly less than the interior diameter of the sealed joint housing member 512 such that the sealed joint insert member 612 can in fact be accommodated within the sealed joint housing member 512 as can be readily seen in FIG. 13. Still yet further, in utilizing the sealed joint assembly, comprising the sealed joint housing 510 and the sealed joint insert 610, to fixedly secure the opposite ends of a plastic strapping together, it is to be appreciated that each one of the opposite ends 714,716 of the plastic strapping, which is to be disposed around the baled material, is respectively folded over onto itself so as to effectively form a looped member 718,720 which has a substantially key-hole configuration as can best be appreciated from FIG. 14.

Accordingly, after the plastic strapping is disposed around the particular baled material, the ends 714,716 of the plastic strapping are inserted into the slots 514,514 defined within the sealed joint housing member 512 such that the looped members 718,720 will be disposed internally within the sealed joint housing member 512, it of course being additionally noted the width dimension of each one of the slots 514, 514 formed within the sealed joint housing member 512 is greater than the dual-ply thickness of each one of the opposite ends 714,716 of the plastic strapping which are folded over upon itself so as to in fact permit the dual-ply thickness ends 714,716 of the plastic strapping to in fact be inserted into the slots 514,514 of the sealed joint housing member 512, however, the diametrical extent of each one of the looped members 718,720 of the opposite ends 714,716 of the plastic strapping is greater than the width dimensions of the slots 514,514. Accordingly, the looped members 718,720 of the opposite ends 714,716 of the plastic strapping will effectively be trapped internally within the sealed joint housing member 512. Continuing further, in order to ensure that the looped members 718,720 of the opposite ends 714,716 of the plastic strapping are in fact retained internally within the sealed joint housing member 512, and to effectively connect the opposite ends 714,716 of the plastic strapping together such that the plastic strapping will in fact be fixedly retained around the baled material despite the tendency of the baled material to subsequently expand back toward its original state after being compressed and secured by means of the plastic strapping, the free end portions 614,614 of the sealed joint insert 610 are inserted through the looped members 718,720 of the opposite ends 714,716 of the plastic strapping. Therefore, when the baled material tends to undergo expansion and impresses substantial forces upon the plastic strapping, the opposite ends 714,716 of the plastic strapping will be fixedly retained within the sealed joint assembly, comprising the sealed joint housing 510 and the sealed joint insert 610, as a result of the structural inter-cooperation defined between the looped members 718,720 of the opposite ends 714,716 of the plastic strapping, the free end portions 614,614 of the sealed joint insert 610, and the slotted regions 514,514 of the sealed joint housing member 512. It is lastly noted that the sealed joint housing 510 and the sealed joint insert 610 components may be fabricated from different materials, such as, for example, steel, aluminum, plastic, metal-reinforced plastic, or the like, based, for example, upon required strength considerations or parameters.

Thus, it may be seen that in accordance with the principles and teachings of the present invention, several different embodiments of sealed joint assemblies have been disclosed for securing together the opposite ends of plastic strapping which is encircled around the package or bale in order to ensure that the opposite ends of the plastic strapping do not exhibit any slipping or relative movement with respect to each other whereby the predeterminedly formed size or shape of the package or bale is able to be preserved or maintained such that, in addition, the structural integrity of the package or bale is maintained, for example, during transportation, shipping, and handling of the bale or package. The different embodiments of the sealed joint assemblies may comprise friction-enhancing means defined between the opposite ends of the plastic strapping and the sealed joint components, or between the opposite ends of the plastic strapping per se, or alternatively, may comprise structural means which effectively trap the opposite ends of the plastic strapping within the sealed joint assembly.

Obviously, many variations and modifications of the present invention are possible in light of the above teachings. It is therefore to be understood that within the scope of the appended claims, the present invention may be practiced otherwise than as specifically described herein.

What is claimed as new and desired to be protected by Letters Patent of the United States of America, is:

1. A crimped sealed joint assembly for fixedly securing the opposite ends of plastic strapping together, wherein the plastic strapping is disposed around an article, comprising:

a plastic strapping having opposite ends to be fixedly secured together with respect to each other;

sealed joint structure within which said opposite ends of said plastic strapping are disposed such that said opposite ends of said plastic strapping can be fixedly secured together with respect to each other; and friction enhancing means, disposed upon any two predetermined surface portions of said opposite ends of said plastic strapping, and said sealed joint structure, which are disposed in surface-to-surface contact with each other, for enhancing the fixation of said opposite ends of said plastic strapping with respect to each other within said sealed joint structure;

said sealed joint structure being crimpingly engaged onto said opposite ends of said plastic strapping so as to enhance the frictional interaction properties between said any two predetermined surface portions of said opposite ends of said plastic strapping, and said sealed joint structure, which are disposed in surface-to-surface contact with each other, whereby the degree of slipperiness, between said opposite ends of said plastic strapping and said sealed joint structure, will be substantially reduced so as to effectively fixedly secure said opposite ends of said plastic strapping together with respect to each other within said sealed joint structure;

wherein said sealed joint structure comprises a sealed joint housing comprising an upper wall member, a lower wall member spaced from said upper wall member, and a pair of spaced side wall members so as to define an open space therebetween, and a sealed joint insert disposed internally within said sealed joint housing so as to effectively divide said open space of said sealed joint housing, defined between said upper and lower wall members and said pair of spaced side wall members, into upper and lower spaces within which said opposite ends of said plastic strapping are disposed in contact with said sealed joint insert so as to fixedly retain said opposite ends of said plastic strapping within said sealed joint housing while said opposite ends of said plastic strapping are not disposed in contact with each other, one of said wall members comprising said upper wall member and said pair of side wall members having slots defined therein such that when said sealed joint insert is disposed within said sealed joint housing, portions of said sealed joint insert project outwardly through said slots defined within said wall members of said sealed joint housing.

2. The sealed joint assembly as set forth in claim 1, wherein:

said friction enhancing means is disposed upon an undersurface portion of said upper wall member of said sealed joint housing, upon an upper surface portion of said lower wall member of said sealed joint housing, and upon upper and lower surface portions of said sealed joint insert whereby said friction enhancing means disposed upon said undersurface portion of said upper wall member of said sealed joint housing, and said friction enhancing means disposed upon said upper surface portion of said sealed joint insert, will respectively frictionally engage upper and lower surface portions of the one end of said plastic strapping disposed within said upper space defined within said sealed joint housing, while said friction enhancing means disposed upon said upper surface portion of said lower wall member of said sealed joint housing, and said friction enhancing means disposed upon said undersurface portion of said sealed joint insert, will respectively frictionally engage upper and lower surface portions of the other end of said plastic strapping disposed within said lower space defined within said sealed joint housing.

3. The sealed joint assembly as set forth in claim 1, wherein:

said sealed joint housing comprises side wall members, interconnecting said upper and lower wall members, having slots defined therein; and said sealed joint insert is disposed within said sealed joint housing such that portions of said sealed joint insert project outwardly through said slots defined within said side wall members of said sealed joint housing.

4. The sealed joint assembly as set forth in claim 3, wherein:

said sealed joint insert has a substantially rectangular configuration wherein opposite ends of said rectangularly configured sealed joint insert project outwardly through said slots defined within said side wall members of said sealed joint housing.

5. The sealed joint assembly as set forth in claim 3, wherein:

said sealed joint insert has a substantially t-shaped configuration comprising a longitudinally extending body portion and a pair of ears integrally disposed upon side edge portions of said body portion wherein said ears project outwardly through said slots defined within said side wall members of said sealed joint housing.

6. The sealed joint assembly as set forth in claim 1, wherein:

said sealed joint housing has slots defined within said upper wall member; and said sealed joint insert is disposed within said sealed joint housing such that portions of said sealed joint insert project outwardly through said slots defined within said upper wall member of said sealed joint housing.

7. A crimped sealed joint assembly for fixedly securing the opposite ends of plastic strapping together, wherein the plastic strapping is disposed around an article, comprising:

a plastic strapping having opposite ends to be fixedly secured together with respect to each other;

sealed joint structure within which said opposite ends of said plastic strapping are disposed such that said opposite ends of said plastic strapping can be fixedly secured together with respect to each other; and friction enhancing means, disposed upon predetermined surface portions of at least one of said plastic strapping and said sealed joint structure, which are disposed in surface-to-surface contact with each other, for enhancing the fixation of said opposite ends of said plastic strapping with respect to each other within said sealed joint structure;

said sealed joint structure being crimpingly engaged onto said opposite ends of said plastic strapping so as to enhance the frictional interaction properties between said predetermined surface portions of at least one of said plastic strapping and said sealed joint structure which are disposed in surface-to-surface contact with each other, whereby the degree of slipperiness, between said plastic strapping and said sealed joint structure, will be substantially reduced so as to effectively fixedly secure said opposite ends of said plastic strapping together with respect to each other within said sealed joint structure;

wherein said sealed joint structure comprises a sealed joint housing comprising an upper wall member, a lower wall member spaced from said upper wall member, and a pair of spaced side wall members so as to define an open space therebetween, and a sealed joint insert disposed internally within said sealed joint housing so as to effectively divide said open space of said sealed joint housing, defined between said upper and lower wall members and said pair of spaced side wall members, into upper and lower spaces within which said opposite ends of said plastic strapping are disposed in contact with said sealed joint insert so as to fixedly retain said opposite ends of said plastic strapping within said sealed joint housing while said opposite ends of said plastic strapping are not disposed in contact with each other, one of said wall members comprising said upper wall member and said pair of side wall members having slots defined therein such that when said sealed joint insert is disposed within said sealed joint housing, portions of said sealed joint insert project outwardly through said slots defined within said wall members of said sealed joint housing.

8. The sealed joint assembly as set forth in claim 7, wherein:

said friction enhancing means is disposed upon an undersurface portion of said upper wall member of said sealed joint housing, upon an upper surface portion of said lower wall member of said sealed joint housing, and upon upper and lower surface portions of said sealed joint insert whereby said friction enhancing means disposed upon said undersurface portion of said upper wall member of said sealed joint housing, and said friction enhancing means disposed upon said upper surface portion of said sealed joint insert, will respectively frictionally engage upper and lower surface portions of the one end of said plastic strapping disposed within said upper space defined within said sealed joint housing, while said friction enhancing means disposed upon said upper surface portion of said lower wall member of said sealed joint housing, and said friction enhancing means disposed upon said undersurface portion of said sealed joint insert, will respectively frictionally engage upper and lower surface portions of the other end of said plastic strapping disposed within said lower space defined within said sealed joint housing.

9. The sealed joint assembly as set forth in claim 7, wherein:

said sealed joint housing comprises side wall members, interconnecting said upper and lower wall members, having slots defined therein; and said sealed joint insert is disposed within said sealed joint housing such that portions of said sealed joint insert project outwardly through said slots defined within said side wall members of said sealed joint housing.

10. The sealed joint assembly as set forth in claim 9, wherein:

said sealed joint insert has a substantially rectangular configuration wherein opposite ends of said rectangularly configured sealed joint insert project outwardly through said slots defined within said side wall members of said sealed joint housing.

11. The sealed joint assembly as set forth in claim 9, wherein:

said sealed joint insert has a substantially t-shaped configuration comprising a longitudinally extending body portion and a pair of ears integrally disposed upon side edge portions of said body portion wherein said ears project outwardly through said slots defined within said side wall members of said sealed joint housing.

12. The sealed joint assembly as set forth in claim 7, wherein:

said sealed joint housing has slots defined within said upper wall member; and said sealed joint insert is disposed within said sealed joint housing such that portions of said sealed joint insert project outwardly through said slots defined within said upper wall member of said sealed joint housing.

* * * * *